US006487969B2

(12) United States Patent
Chau et al.

(10) Patent No.: US 6,487,969 B2
(45) Date of Patent: Dec. 3, 2002

(54) HEAT SENSITIVE PRINTING PLATE PRECURSORS

(75) Inventors: Tu Vinh Chau, Wackerheim (DE); Jacek Paul Obuchowicz, Melbourn (GB)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/730,058

(22) Filed: Dec. 5, 2000

(65) Prior Publication Data

US 2001/0018877 A1 Sep. 6, 2001

(30) Foreign Application Priority Data

Dec. 7, 1999 (GB) ..... 9928896

(51) Int. Cl.[7] ..... B41C 1/10; B41N 3/03; B41N 3/04

(52) U.S. Cl. ..... 101/467; 101/459; 205/127; 205/921

(58) Field of Search ..... 101/454, 456, 101/458, 459, 465, 467; 205/127, 139, 153, 201, 213, 214, 229, 921; 430/303

(56) References Cited

U.S. PATENT DOCUMENTS 4,034,183 A * 7/1977 Uhlig ..... 219/121.58
4,168,167 A 9/1979 Takenaka et al. ..... 430/264
4,970,116 A 11/1990 Kimura et al. ..... 430/302
5,282,952 A * 2/1994 Sakaki ..... 205/153
5,503,074 A * 4/1996 Hirano et al. ..... 101/459
5,834,129 A 11/1998 Dhillon et al. ..... 428/654

FOREIGN PATENT DOCUMENTS

EP 0 659 909 B1 11/1999

* cited by examiner

*Primary Examiner*—Stephen R. Funk
(74) *Attorney, Agent, or Firm*—Leydig, Voit & Mayer, Ltd.

(57) ABSTRACT

A lithographic printing plate precursor comprises an electrochemically grained aluminium substrate, the grained surface of which is coated with a layer of gel-like amorphous colloidal oxides and hydroxides of aluminium and their hydrates incorporating metallic aluminium and intermetallic aluminium alloys—generally at a level of below 5%—this layer being produced during the electrochemical graining process. The layer is typically present in an amount of from 0.1–20 g/m$^2$ and at a layer thickness of 0.1–4.0 $\mu$m, the particle sizes in the said layer generally falling in the range of from 10 to 2000 nm. Methods are disclosed for the preparation of said precursors via the electrochemical graining of aluminium substrates. The invention provides lithographic printing plate precursors which may be imagewise exposed by means of a high intensity laser beam to provide printing plates showing high durability on press and giving images which show good resolution and are free from background staining.

10 Claims, No Drawings

HEAT SENSITIVE PRINTING PLATE PRECURSORS

FIELD OF THE INVENTION

This invention relates to the formation of images directly from electronically composed digital sources and is particularly concerned with the formation of images on lithographic printing plate precursors. More particularly, the invention relates to lithographic printing plate precursors which incorporate an imaging layer comprising gel-like amorphous colloidal oxides and hydroxides of aluminium and their hydrates incorporating metallic aluminium and intermetallic aluminium alloys, and a method of preparing lithographic printing plates wherein image formation is achieved by means of exposure to thermal radiation, and which does not require the use of chemical treatments.

BACKGROUND OF THE INVENTION

Lithographic printing is a process of printing from surfaces which have been prepared in such a way that certain areas are capable of accepting ink (oleophilic areas), whereas other areas will not accept ink (oleophobic areas). The oleophilic areas form the printing areas while the oleophobic areas form the background areas.

Plates for use in lithographic printing processes may be prepared using a photographic material that is made imagewise receptive or repellent to ink upon photo-exposure of the photographic material and subsequent chemical treatment. However, this method of preparation, which is based on photographic processing techniques, involves several steps, and therefore requires a considerable amount of time, effort and expense.

Consequently it has, for many years, been a long term aim in the printing industry to form images directly from an electronically composed digital database, ie by a so-called "computer-to-plate" system. The advantages of such a system over the traditional methods of making printing plates are:

(i) the elimination of costly intermediate silver film and processing chemicals;
(ii) a saving of time; and
(iii) the ability to automate the system with consequent reduction in labour costs.

The introduction of laser technology provided the first opportunity to form an image directly on a printing plate precursor by scanning a laser beam across the surface of the precursor and modulating the beam so as to effectively turn it on and off. In this way, radiation sensitive plates comprising a high sensitivity polymer coating have been exposed to laser beams produced by water cooled UV argon-ion lasers and electrophotographic plates having sensitivities stretching into the visible spectral region have been successfully exposed using low powered air-cooled argon-ion, helium-neon and semiconductor laser devices.

Imaging systems are also available which involve a sandwich structure which, on exposure to a heat generating infra-red laser beam, undergoes selective (imagewise) delamination and subsequent transfer of materials. Such so-called peel-apart systems are generally used as replacements for silver halide films.

A digital imaging technique has been described in U.S. Pat. No. 4,911,075 whereby a so-called driographic plate which does not require dampening with an aqueous fountain solution to wet the non-image areas during printing is produced by means of a spark discharge. In this case, a plate precursor comprising an ink-repellent coating containing electrically conductive particles coated on a conductive substrate is used and the coating is ablatively removed from the substrate. Unfortunately, however, the ablative spark discharge provides images having relatively poor resolution.

It is known to improve this feature by the use of lasers to obtain high resolution ablation as described, for example, by P E Dyer in "Laser Ablation of Polymers" (Chapter 14 of "Photochemical Processing of Electronic Materials", Academic Press, 1992, p359–385). Until recently, imaging via this method generally involved the use of high power carbon dioxide or excimer lasers. Unfortunately, such lasers are not well-suited to printing applications because of their high power consumption and excessive cost, and the requirement for high pressure gas handling systems. Recent developments have, however, led to the availability of more suitable infra-red diode lasers, which are compact, highly efficient and very economical solid state devices. High power versions of such lasers, which are capable of delivering up to 3000 $mJ/cm^2$, are now commercially available.

Coatings which may be imaged by means of ablation with infra-red radiation have previously been proposed. Thus, for example, a proofing film in which an image is formed by imagewise ablation of a coloured layer on to a receiver sheet is described in PCT Application No. 90/12342. This system is, however, disadvantageous in requiring a physical transfer of material in the imaging step, and such methods tend to give rise to inferior image resolution.

Much superior resolution is obtained by means of the ablation technique described in European Patent No 649374, wherein a driographic printing plate precursor is imaged digitally by means of an infra-red diode laser or a YAG laser, and the image is formed directly through the elimination of unwanted material. The technique involves exposing a plate precursor, incorporating an infra-red radiation ablatable coating covered with a transparent cover sheet, by directing the beam from an infra-red laser at sequential areas of the coating so that the coating ablates and loses its ink repellancy in those areas to form an image, removing the cover sheet and ablation products, and inking the image.

A heat mode recording material is disclosed in U.S. Pat. No. 4,034,183 which comprises an anodised aluminium support coated with a hydrophilic layer. On imagewise exposure using a laser, the exposed areas are rendered hydrophobic, and thereby accept ink.

Japanese patent application laid open to public inspection No 49-117102 (1974) discloses a method for producing printing plates wherein a metal is incorporated in the imaging layer of a printing plate precursor which is imaged by irradiation with a laser beam modulated by electric signals. Typically, the plate precursor comprises a metal base, such as aluminium, coated with a resin film, which is typically nitrocellulose, and on top of which has been provided a thin layer of copper. The resin and metal layers are removed in the laser-struck areas, thereby producing a printing plate. The disadvantage of this system, however, is that two types of laser beam irradiation are required in order to remove firstly the copper (eg by means of an argon-ion laser) and then the resin (eg with a carbon dioxide laser); hence, the necessary equipment is expensive.

Subsequently a method of printing plate production which obviated the requirement for a second laser exposure was disclosed in Japanese patent application laid open to public inspection No 52-37104 (1977). Thus, a printing plate precursor comprising a support, typically aluminium, an anodic aluminium oxide layer, and a layer of brass, silver, graphite or, preferably, copper is exposed to a laser beam of high energy density in order to render the exposed areas hydrophilic to yield a printing plate. The printing plate precursor is, however, of rather low sensitivity and requires the use of a high energy laser for exposure.

An alternative heat mode recording material for making a lithographic printing plate is disclosed in European Patent No 609941, which comprises a support having a hydrophilic surface, or provided with a hydrophilic layer, on which is coated a metallic layer, on top of which is a hydrophobic layer having a thickness of less than 50 nm. A lithographic printing plate may be produced from the said material by imagewise exposing to actinic radiation, thereby rendering the exposed areas hydrophilic and repellent to greasy ink.

Conversely, European Patent No 628409 discloses a heat mode recording material for making a lithographic printing plate which comprises a support and a metallic layer, on top of which is provided a hydrophilic layer having a thickness of less than 50 nm. A lithographic printing plate is produced by imagewise exposing the material to actinic radiation in order to render the exposed areas hydrophobic and receptive to greasy ink.

In each of the two foregoing heat mode recording materials, however, difficulties in printing will be encountered. On exposure of the materials to actinic radiation, the energy is converted to heat in the image areas by interaction with the metallic layer, thereby destroying the hydrophilicity or hydrophobicity—depending on the material employed—of the topmost layer in those areas. Consequently, the surface of the metallic layer becomes exposed, and the success of the printing operation is dependent upon differences in hydrophilicity and oleophilicity between the metallic surface and the hydrophilic or hydrophobic layer, as the case may be. Since the metallic layer functions as the hydrophobic surface in one case, and as the hydrophilic surface in the alternative case, it would be expected that such differences in hydrophilicity and oleophilicity would not be sufficiently clearly defined so as to provide a satisfactory printing surface. Furthermore, when a hydrophilic layer is present, and the metallic surface functions as the oleophilic areas of the plate, image areas will necessarily be printed from the metallic surface; such an arrangement is known to be unsatisfactory, and to result in difficulties in achieving acceptable printing quality.

Subsequently, imaging systems have been provided wherein a radiation sensitive layer comprising metallic silver is applied to a grained and anodised aluminium substrate, the resulting lithographic printing plates being imaged by exposure to thermal radiation which causes ablation of the silver layer in the radiation struck areas. The resulting systems, which are described in PCT patent applications WO 98/55307–WO 98/55311 and WO 98/55330–WO 98/55332 provide press ready plates showing high image quality, good press properties and high durability on press without the requirement for the use of costly intermediate film and developer chemistry and the attendant inconvenience resulting from the use of these materials. However, the plates do utilise costly silver intermediates in their manufacture and, as a consequence, are expensive to use. Indeed, in all of the systems of the prior art, it is necessary that a costly radiation sensitive layer should be applied to a prepared substrate in order to provide an imaging system.

Consequently, it is an object of the present invention to provide an imaging system which obviates the requirement for the use of costly radiation sensitive imaging layers.

It is a further object of the present invention to provide a lithographic printing plate having excellent printing properties, and a method of making said plate which obviates the requirement for the use of processing developers after exposure.

It is a still further object of the present invention to provide a method of preparing a lithographic printing plate which does not require the use of costly intermediate film and relies on direct-to-plate exposure techniques.

It is also an object of the present invention to provide a method of producing a lithographic printing plate in which a high quality image results from the ablation of a layer from a hydrophilic support, thus providing a high degree of differentiation between hydrophilic and oleophilic areas.

BRIEF SUMMARY OF THE INVENTION

The present invention provides in one aspect a method for making a lithographic printing plate. The method comprises the steps of providing a lithographic printing plate precursor comprising an electrochemically grained aluminium substrate, the grained surface of which is coated with a smut layer comprising amorphous colloidal oxides and hydroxides of aluminium and their hydrates incorporating metallic aluminium and inter-metallic aluminium alloys, and exposing the lithographic printing plate precursor to heat, wherein the smut layer is removed from the substrate by ablation.

According to a first aspect of the present invention there is provided a lithographic printing plate precursor comprising an electrochemically grained aluminium substrate, the grained surface of which is coated with a layer of gel-like amorphous colloidal oxides and hydroxides of aluminium and their hydrates incorporating metallic aluminium and inter-metallic aluminium alloys, the said layer being produced during the electrochemical graining process.

Said layer of gel-like amorphous colloidal oxides and hydroxides of aluminium and their hydrates incorporating metallic aluminium and inter-metallic aluminium alloys is commonly referred to as a 'smut' layer, and said inter-metallic aluminium alloys comprise alloys of aluminium with the other metals generally present in lithographic quality aluminium. Said metals primarily include manganese and iron, which may be present in amounts of between 0.5 and 1.0%, together with lesser quantities of other metals, such as magnesium, copper, zinc and titanium. In any event, the overall level of metallic aluminium and inter-metallic aluminium alloys present in the layer of amorphous colloidal oxides and hydroxides of aluminium and their hydrates rarely exceeds 5% and, in general, these materials would be present at levels below 1%.

The chemical graining process is preferably an electrochemical graining process which is carried out by passing the aluminium substrate through a bath containing at least a mineral acid, under the influence of an electric current.

Preferably, said mineral acid is hydrochloric or nitric acid, which is applied to the aluminium surface either alone or in combination with another acid, preferably an organic acid such as acetic acid. Said organic acid is advantageously present at a level of 0–80%, preferably 0–10%, most preferably 0–5%. Especially effective results are obtained with a mixture of hydrochloric and acetic acids in the ratio of 2:1 to 1:4, preferably 1:2. Optionally said mineral acid may also contain amounts of salts at a level of 0–80%, preferably 0–20%; suitable examples of such salts include aluminium chloride, aluminium sulphate, aluminium nitrate, ammonium chloride and potassium hexafluorozirconate.

The electric current may be a direct current or an alternating current, but is most preferably an alternating current having a current density of from 500–5000 $A/m^2$, most particularly from 2000–3000 $A/m^2$. The current can be applied in AC, sine or square waveforms having from 1 to 6 phases, with either positive or negative biasing, at ±10 V. The charge densities are from 1 to 1000 $C/dm^2$, preferably from 200 to 1000 $C/dm^2$. The graining process is carried out at a temperature of from 0–100° C., preferably from 20–50° C., for a dwell time of from 2 seconds to 3 minutes, preferably from 2 seconds to 20 seconds.

The layer of smut is preferably present in an amount of from 0.1–20 $g/m^2$, giving a layer thickness of from 0.1–4.0 $\mu$m. The particle sizes in the said layer typically range from 10 to 2000 nm, preferably from 50 to 500 nm, in diameter.

The substrate employed in the present invention is an aluminium substrate which is chemically grained on at least one surface in order to enhance its lithographic properties. Optionally, however, the aluminium may be laminated to other materials, such as paper or various plastics materials, in order to enhance its flexibility, whilst retaining the good dimensional stability associated with aluminium.

Preferably, the plate precursors according to the first aspect of the present invention additionally include an anodic layer, said layer comprising oxides of aluminium and being formed by means of an electrochemical anodising process. Said process involves treatment of the grained substrate, including the smut layer, in an acid bath, preferably comprising at least a mineral acid, in the presence of an electric current. Typically the mineral acid comprises sulphuric or phosphoric acid, or a mixture of the two acids, preferably in a ratio of from 1:10 to 1:1, most preferably in a ratio of around 1:7. The process could suitably be carried out using, for example, a total acid concentration of 8–15%, with a dwell time of from 2 seconds to 2 minutes, in a bath having a temperature of from 10° to 50° C. A suitable current density for the process would be in the region of 1000 $A/m^2$.

In order that a high degree of differentiation in terms of oleophilicity and hydrophilicity should be achieved between image and non-image areas, it is required that the entire layer of smut should be ablated from the substrate, and it is preferred that the lithographic printing plate should include a top layer comprising an oleophilic material, such as a binder resin, an organic compound—for example octylmercaptotetrazole—or a metal such as silver or copper. Preferably, said oleophilic material comprises a polymeric material such as a polyurethane, nylon, (meth)acrylate, styrene, acrylonitrile or novolak resin or copolymer, but is most preferably a carboxylated polymer obtained by reacting a proportion of the residual hydroxy groups in a poly (vinyl acetal) resin, such as poly(vinyl butyral), with an acid anhydride, for example trimellitic anhydride, maleic anhydride or, preferably, phthalic anhydride.

As an alternative, it is possible to include a top layer comprising a material having a greater degree of hydrophilicity than the smut layer; this allows areas of differential ink acceptance to be provided following exposure of the material such that partial ablation of the lower layer occurs. Particularly favourable results are achieved with a hydrophilic layer comprising titanium dioxide, silicon dioxide and poly(vinyl alcohol), and the effect may be further enhanced by treatment of the anodised substrate surface with an agent capable of increasing its degree of hydrophobicity; suitable results in this regard are achieved by the use of complex salts such as potassium hexafluorozirconate.

As a still further alternative, a so-called driographic plate may be obtained by applying a top layer comprising an oleophobic material, typically an oleophobic polymeric resin, preferably a polysiloxane. Such driographic plates are advantageous in that printing may be carried out on presses without the need for damping solutions to be employed.

Optionally, an intermediate layer may be present between said smut layer and said top layer. Said intermediate layer may include a dynamic release accelerator which increases the rate of ablation of the material of the top layer during exposure of the printing plate precursor, thereby increasing the exposure sensitivity of the precursor. Suitable dynamic release accelerators could comprise, for example, a very thin layer of silver metal, but, more generally will include polymeric materials which undergo thermal decomposition, typical examples being azide or cellulosic polymers, polysulphones, polycarbonates and methacrylate polymers, such as tertiary butyl methacrylate polymers; most preferably, however, the dynamic release accelerator comprises nitrocellulose.

A second aspect of the current invention concerns a method for the preparation of lithographic and driographic printing plate precursors as envisaged according to the first aspect of the invention, said method comprising electrochemically graining an aluminium substrate in the manner hereinbefore described.

Furthermore, according to a third aspect of the present invention, there is provided a method of preparing a lithographic printing plate, said method comprising:

a) providing a lithographic printing plate precursor as hereinbefore described;
b) imagewise exposing said precursor by means of a high intensity laser beam;
and
c) removing extraneous material from imaged areas.

In order to prepare a lithographic printing plate, the precursor is imaged by a beam of radiation, preferably from a laser operating in the infra-red region of the spectrum. Examples of suitable infra-red lasers include semiconductor lasers and YAG lasers, for example the Agfa Galileo 2 Platesetter with a 12 W YAG laser outputting at 1064nm. Exposure to the beam of radiation causes ablation of the smut layer to occur in the radiation-struck areas.

In the case wherein the precursor includes a top layer comprising an oleophilic material, it is found that the said layer is generally ablated from the plate on exposure, together with the greater part of the smut layer. Remaining parts of said smut layer may subsequently be removed by simple physical rubbing with a dry or damp cloth, or by treatment with a suitable plate cleaning solution, such as NORMAKLEEN™, FORTAKLEEN™or KLEENGUM™.

However, when the precursor is a driographic printing plate precursor incorporating a hydrophobic top layer, this layer is not ablatively removed on exposure, nor by physical rubbing. Consequently, treatment with a processing solution is required in order to provide a press-ready plate. Suitable treatment solutions typically include PP1 and PA1.

The lithographic printing plates obtained by the method according to the second aspect of the present invention may be used on printing presses to obtain in excess of 50,000 high quality copies showing good resolution, and free from background staining.

aluminium oxide, were prepared according to the test conditions detailed in Table 1. Colour and optical density values were measured for exposed and unexposed specimens of each sample. The results are also summarised in Table 1.

In accordance with expectations, it was observed that, for a grainer bath having a given acid composition, levels of smut decreased as current density increased. This effect is believed to be associated with a degree of colloid removal, which may be induced by the more stringent conditions.

When certain of the samples of substrate were tested on a printing press, they were found to have excellent lithographic properties, including rapid roll-up and clean-up, together with very good ink/water balance and damping latitude.

Key to Symbols in Table 1

CLA=Centre Line Average
Exp=Exposed to radiation
Unexp=Unexposed
$L_{exp}$=CIE colorimetric measurement of exposed plate
$L_{unexp}$=CIE colorimetric measurement of unexposed plate The CIE measurements are produced on a scale wherein black=0 and white=100.

TABLE 1

SUMMARY OF PROCESSING CONDITIONS FOR SUBSTRATE INCORPORATING ABLATABLE LAYER OF SMUT

| Test | Grainer | | | Grainer | | Grainer | | Grainer | Anodiser | | Anodiser | | Anodising | Comments | | | |
|---|---|---|---|---|---|---|---|---|---|---|---|---|---|---|---|---|---|
| Number | conditions | | | power | | temp | CLA | Conductivity | conditons | | power | | On | Optical | Density | Colour | |
| 17B9X3 | HCl | HAc | Al | A | V | Deg C. | μm | mS | $H_2SO_4$ | Al | A | V | Yes | Exp | Unexp | $L_{exp}$ | $L_{unexp}$ |
| 1 | 8.5 | 21.7 | 0.7 | 700 | 14 | 26 | 0.50 | 83 | 94.6 | 3.1 | 320 | 17 | Yes | | | | |
| 1a | 8.5 | 21.7 | 0.7 | 700 | 14 | 26 | | 83 | 94.6 | 3.1 | 0 | 0 | No | | | | |
| 9 | 41.8 | 22.8 | 1.1 | 2100 | 14 | 26 | 0.68 | 270 | 94.6 | 3.1 | 320 | 17 | Yes | | | | |
| 9a | 41.8 | 22.8 | 1.1 | 2100 | 14 | 26 | | 270 | 94.6 | 3.1 | 0 | 0 | No | | | | |
| 10 | 41.8 | 22.8 | 1.1 | 1600 | 8 | 26 | 0.56 | 270 | 94.6 | 3.1 | 320 | 17 | Yes | | | 41.0 | 59.4 |
| 10a | 41.8 | 22.8 | 1.1 | 1600 | 8 | 26 | | 270 | 94.6 | 3.1 | 0 | 0 | No | | | | |
| 8 | 41.8 | 22.8 | 1.1 | 1850 | 8 | 36 | 0.80 | 270 | 94.6 | 3.1 | 320 | 17 | Yes | | | | |
| 8a | 41.8 | 22.8 | 1.1 | 1850 | 8 | 36 | | 270 | 94.6 | 3.1 | 0 | 0 | No | | | | |
| 17 | 42.1 | 24.7 | 2.0 | 1350 | 4 | 36 | 0.70 | 270 | 94.6 | 3.1 | 320 | 17 | Yes | | | | |
| 17a | 42.1 | 24.7 | 2.0 | 1350 | 4 | 36 | | 270 | 94.6 | 3.1 | 0 | 0 | No | | | | |
| 18 | 42.1 | 24.7 | 2.0 | 840 | 2 | 36 | 0.56 | 270 | 94.6 | 3.1 | 320 | 17 | Yes | 0.63 | 0.43 | 41.8 | 50.4 |
| 18a | 42.1 | 24.7 | 2.0 | 840 | 2 | 36 | | 270 | 94.6 | 3.1 | 0 | 0 | No | | | | |
| 7 | 28.7 | 28.7 | 1.5 | 2000 | 16 | 36 | 1.4+ | 200 | 94.6 | 3.1 | 320 | 17 | Yes | | | | |
| 7a | 28.7 | 28.7 | 1.5 | 2000 | 16 | 36 | | 200 | 94.6 | 3.1 | 0 | 0 | No | | | | |
| 19 | 28.7 | 28.7 | 1.5 | 800 | 2 | 36 | 0.55 | 200 | 94.6 | 3.1 | 300 | 17 | Yes | 0.77 | 0.49 | 36.8 | 48.2 |
| 19a | 28.7 | 28.7 | 1.5 | 800 | 2 | 36 | | 200 | 94.6 | 3.1 | 0 | 0 | No | | | | |
| 2 | 17.9 | 20.3 | 0.9 | 800 | 4 | 26 | | 150 | 94.6 | 3.1 | 300 | 17 | Yes | 0.52 | 0.26 | 43.7 | 59.2 |
| 2a | 17.9 | 20.3 | 0.9 | 800 | 4 | 26 | | 150 | 94.6 | 3.1 | 0 | 0 | No | | | | |
| 3 | 17.9 | 20.3 | 0.9 | 800 | 2 | 30 | | 150 | 94.6 | 3.1 | 320 | 19 | Yes | 0.82 | 0.36 | 35.0 | 53.4 |
| 3a | 17.9 | 20.3 | 0.9 | 800 | 2 | 30 | | 150 | 94.6 | 3.1 | 0 | 0 | No | | | | |
| 11 | 25.4 | 0.8 | 0.8 | 670 | 4 | 26 | 0.42 | 200 | 96.5 | 4.5 | 300 | 17 | Yes | 0.79 | 0.46 | 36.1 | 49.6 |
| 11a | 25.4 | 0.8 | 0.8 | 670 | 4 | 26 | | 200 | 96.5 | 4.5 | 0 | 0 | No | | | | |
| 12 | 25.4 | 0.8 | 0.8 | 720 | 4 | 30 | 0.53 | 200 | 96.5 | 4.5 | 300 | 17 | Yes | 0.72 | 0.47 | 38.5 | 49.8 |
| 12a | 25.4 | 0.8 | 0.8 | 720 | 4 | 30 | | 200 | 96.5 | 4.5 | 0 | 0 | No | | | | |

The following examples are illustrative of the conditions employed in the preparation of lithographic printing plate precursors according to the invention, without placing any limit on the scope thereof:

EXAMPLES

Several test samples of grained aluminium substrate including a smut layer, with and without an anodic layer of

We claim:

1. A method of making a lithographic printing plate comprising the steps of providing a lithographic printing plate precursor comprising an electrochemically grained aluminium substrate, the grained surface of which is coated with a smut layer comprising amorphous colloidal oxides and hydroxides of aluminium and their hydrates incorporating metallic aluminium and inter-metallic aluminium alloys, and exposing the lithographic printing plate precursor to heat, wherein the smut layer is removed from the substrate by ablation.

2. A method as defined in claim 1 wherein said inter-metallic aluminium alloys comprise alloys of aluminium with at least one of manganese, iron, magnesium, copper, zinc or titanium.

3. A method as defined in claim 1 wherein the level of metallic aluminium and inter-metallic aluminium alloys present in the smut layer does not exceed 5%.

4. A method as defined in claim 1 wherein said smut layer is present in an amount of from about 0.1–20 $g/m^2$ and at a layer thickness of from 0.1–4.0 $\mu$m.

5. A method as defined in claim 1 wherein the particle sizes of said amorphous colloidal oxides and hydroxides of aluminium and their hydrates incorporating metallic aluminium and inter-metallic aluminium alloys range from 10 to 2000 nm in diameter.

6. A method as defined in claim 1 wherein said grained aluminium substrate additionally comprises an anodic layer.

7. A method as defined in claim 1 wherein the lithographic printing plate precursor additionally comprises a top layer comprising an oleophilic material.

8. A method as defined in claim 1 wherein the lithographic printing plate precursor additionally comprises a top layer comprising a hydrophilic material.

9. A method as defined in claim 1 wherein the lithographic printing plate precursor is a driographic printing plate precursor which additionally comprises a top layer comprising an oleophobic polymeric resin.

10. A method as defined in claim 7, 8 or 9 which additionally comprises an intermediate layer below said top layer, said intermediate layer comprising a dynamic release accelerator.

* * * * *